US008696099B2

(12) United States Patent
Ozawa

(10) Patent No.: US 8,696,099 B2
(45) Date of Patent: Apr. 15, 2014

(54) LIQUID EJECTING HEAD AND LIQUID EJECTING APPARATUS HAVING THE SAME

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 22 days.

(21) Appl. No.: 13/246,729

(22) Filed: Sep. 27, 2011

(65) Prior Publication Data

US 2012/0075388 A1 Mar. 29, 2012

(30) Foreign Application Priority Data

Sep. 28, 2010 (JP) ..... 2010-217758

(51) Int. Cl.
*B41J 2/015* (2006.01)
*B41J 2/18* (2006.01)

(52) U.S. Cl.
USPC ..... 347/89; 347/20

(58) Field of Classification Search
None
See application file for complete search history.

(56) References Cited

U.S. PATENT DOCUMENTS

| | | | | |
|---|---|---|---|---|
| 2002/0180827 | A1 | 12/2002 | Hirota | |
| 2009/0244128 | A1 | 10/2009 | Ozawa et al. | |
| 2011/0074883 | A1* | 3/2011 | Ozawa | 347/47 |
| 2012/0081468 | A1 | 4/2012 | Ozawa et al. | |

FOREIGN PATENT DOCUMENTS

| | | |
|---|---|---|
| CN | 101544110 | 9/2009 |
| JP | 06143602 | 5/1994 |
| JP | 2002-355961 | 12/2006 |

* cited by examiner

*Primary Examiner* — Matthew Luu
*Assistant Examiner* — Erica Lin
(74) *Attorney, Agent, or Firm* — Workman Nydegger

(57) ABSTRACT

A liquid ejecting head includes: a pressure generating chamber to which liquid is supplied through a liquid supply channel; a pressure generating unit that generates a variation in pressure in the pressure generating chamber; a nozzle opening that ejects the liquid discharged from the pressure generating chamber according to the variation in pressure to the outside; and a flow channel for circulation that is formed in the nozzle opening side rather than the pressure generating chamber and separates a part of the liquid discharged from the pressure generating chamber. When Ms, Mn, and Mc each are inertances of the liquid supply channel, the nozzle opening, and the flow channel for circulation, a relationship of $Ms \geq (1/Mn+1/Mc)^{-1}$ is established.

8 Claims, 6 Drawing Sheets

LIQUID EJECTING HEAD AND LIQUID EJECTING APPARATUS HAVING THE SAME

The entire disclosure of Japanese Patent Application No: 2010-217758, filed Sep. 28, 2010 is expressly incorporated by reference herein.

BACKGROUND

1. Technical Field

The present invention relates to a liquid ejecting head and a liquid ejecting apparatus having the same, and particularly, to a liquid ejecting head and a liquid ejecting apparatus having the same that are suitable to apply when separating and circulating a part of liquid that is discharged from a pressure generating chamber and ejected through a nozzle opening.

2. Related Art

As a liquid ejecting apparatus, for example, there is an ink jet type recording apparatus provided with an ink jet type recording head including: a plurality of pressure generating chambers that generate pressure for ejecting an ink droplet by a pressure generating unit formed of a piezoelectric element; an ink supply channel that individually supplies the ink from a common reservoir to each pressure generating camber; and a nozzle opening that ejects the ink droplet formed in each pressure generating chamber (for example, refer to JP-A-2002-355961).

In the above-described ink jet type recording apparatus, ejecting energy is applied to the ink in the pressure generating chamber that is communicated with a nozzle corresponding to a printing signal, and the ink droplet is ejected from the nozzle opening to the outside and landed at predetermined positions on media such as a sheet. Therefore, in this kind of ink jet type recording apparatus, the nozzle opening is exposed to the atmosphere. Thus, the ink is thickened due to vaporization via the nozzle opening. As a result, the thickened ink may cause an adverse effect on ejecting characteristics of the ink droplet. That is, if the thickened ink exists at even a portion of the nozzle opening, ejection amount and an ejection speed of the ink droplet through the nozzle opening are changed, and disadvantages such as variation in the landing of the ink occur.

Therefore, the versatile ink jet type recording apparatus according to the related art includes the following methods: 1) before the ink is thickened, the ink jet type recording head is moved to portions other than the media, and the ink in the vicinity of the nozzle opening is always maintained to a fresh state by discharging the ink appropriately; or 2) when the ink droplet is not ejected, vibration is generated at the pressure generating chamber by PZT or the like serving as the pressure generating unit and the thickening of the ink is suppressed to some extent.

However, the versatile ink jet type recording apparatus according to the related art has the following problems. That is, in the case of the above-described 1), the ink is uneconomically discarded, and in the case of the above-described 2), even when the ink is vibrated, it is difficult to prevent sufficiently the ink from thickening due to vaporization of the ink in the vicinity of the nozzle opening.

Therefore, there is also proposed an ink jet type recording head constituted so that a part of ink discharged from the pressure generating chamber and flowed toward the nozzle opening is separated and circulated through a flow channel for circulation, and fresh ink is always supplied to the vicinity of the nozzle opening (Japanese Patent No. 3097718). In the ink jet type recording head adopting the above-described circulating method, since the ink is circulated, the ink in the vicinity of the nozzle opening can be always maintained at a fresh state without discarding the ink and problems of the above-described 1) and 2) can be simultaneously solved.

On the other hand, in the ink jet type recording head adopting the above-described circulating method, since a part of the ink flowed toward the nozzle opening is separated through the flow channel for circulation, the amount of the ink ejected through the nozzle opening is decreased by as much as the separated amount. Therefore, the discharging efficiency of the ink with respect to an excluded volume of the ink is decreased in the pressure generating chamber. That is, in the above-described ink jet type recording head adopting the circulating method, it is very important to obtain the same ejecting characteristics as that of the versatile ink jet type recording apparatus of the related art which does not adopt the circulating method. However, a technology or the like for obtaining the same ejecting characteristics have not yet achieved.

In addition, the above-described problems exist similarly not only in ink jet type recording heads that eject the ink but also in liquid ejecting heads that eject other liquids.

SUMMARY

An advantage of some aspects of the invention is to provide a liquid ejecting head and a liquid ejecting apparatus having the same capable of suppressing thickening of the ejecting liquid while maintaining the same ejecting characteristic as that of a versatile liquid ejecting head of the related art without ejecting and discarding waste liquid.

According to an aspect of the invention, there is provided a liquid ejecting head including: a pressure generating chamber to which liquid is supplied through a liquid supply channel; a pressure generating unit that generates a variation in pressure in the pressure generating chamber; a nozzle opening that ejects the liquid discharged from the pressure generating chamber according to the variation in pressure to the outside; and a flow channel for circulation that is formed in the nozzle opening side rather than the pressure generating chamber and separates a part of the liquid discharged from the pressure generating chamber, wherein when Ms, Mn, and Mc each are inertances of the liquid supply channel, the nozzle opening, and the flow channel for circulation, a relationship of $Ms \geq (1/Mn+1/Mc)^{-1}$ is established.

According to the aspect of the invention, since the liquid ejecting head is constituted so that the condition of the relationship is satisfied, most of the ink discharged from the pressure generating chamber when performing the printing or the like is ejected through the nozzle opening. Therefore, ejecting characteristics of the above case can be the same as that of the ink jet type recording head of the related art which does not have a flow channel for circulation. On the other hand, since the liquid discharged from the pressure generating chamber is circulated in a pathway including the ink supply channel and the pressure generating chamber through the flow channel for circulation, fresh ink can always be supplied to the vicinity of the nozzle opening, and thickening of the ink can be preferably suppressed. As a result, it is possible to effectively prevent the ejecting characteristics of the ink from deteriorating due to the thickening without discarding the ink uneconomically.

In the liquid ejecting head, the flow channel for circulation may be formed in parallel to the nozzle opening. In this case, the above-described operation and effects can be easily and satisfactory exerted.

In addition, in the liquid ejecting head, a relationship of $Mc>Mn$ may be established. In this case, since the inertance Mn of the nozzle opening is smaller than the inertance Mc of the flow channel for circulation, it is possible to more efficiently eject the liquid discharged from the pressure generating chamber through the nozzle opening.

Moreover, in the liquid ejecting head, when Rn and Rc each are pathway resistances of the nozzle opening and the flow channel for circulation, a relationship of Mn/Rn<Mc/Rc may be established. In this case, it is possible to more effectively dampen vibration of the liquid in a nozzle meniscus. Therefore, this case becomes a more effective condition even when applying to a self circulation method in which pressure is generated in the pressure generating chamber by driving the pressure generating unit and the liquid passing through the ink supply channel is circulated.

According to another aspect of the invention, there is provided a liquid ejecting apparatus including at least one of the above-described liquid ejecting heads.

According to the another aspect of the invention, it is possible to provide the liquid ejecting apparatus capable of always maintaining the liquid in the vicinity of the nozzle opening at a fresh state while not discarding uneconomically the liquid and maintaining the satisfactory ejecting characteristics, and of having stable ejecting characteristics and landing performance over a long period.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail with reference to the accompanying drawings.

First Embodiment

Figure 1A:
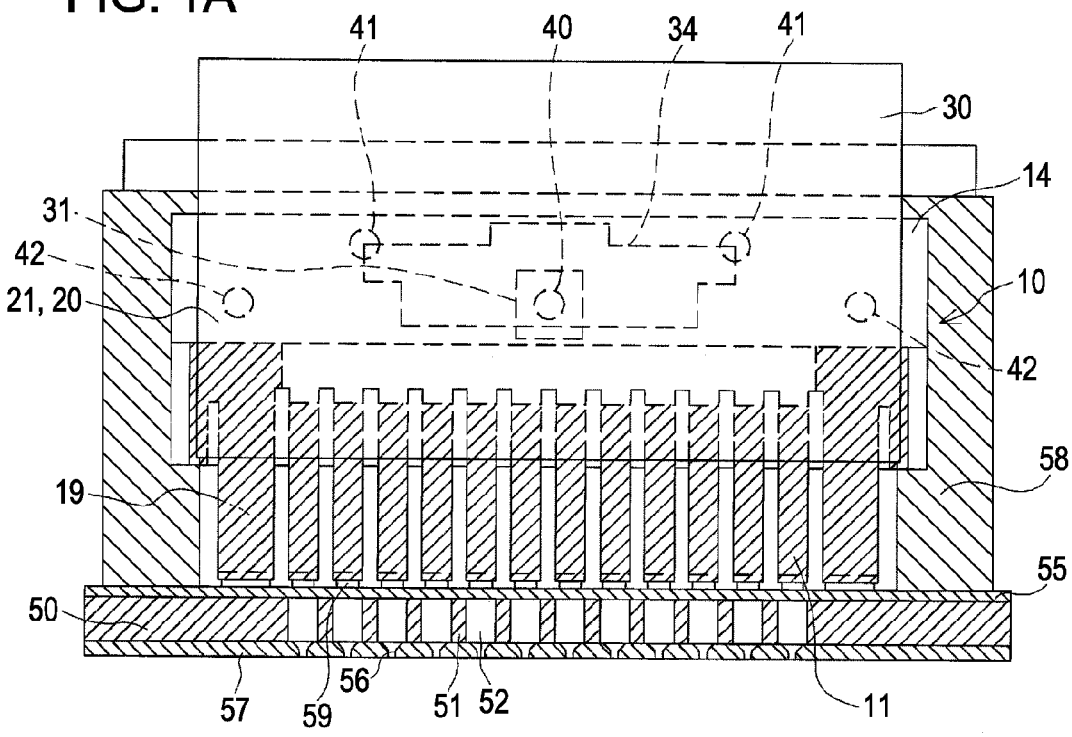
FIGS. 1A and 1B are cross-sectional views showing a recording head according to a first embodiment.
Figure 1B:
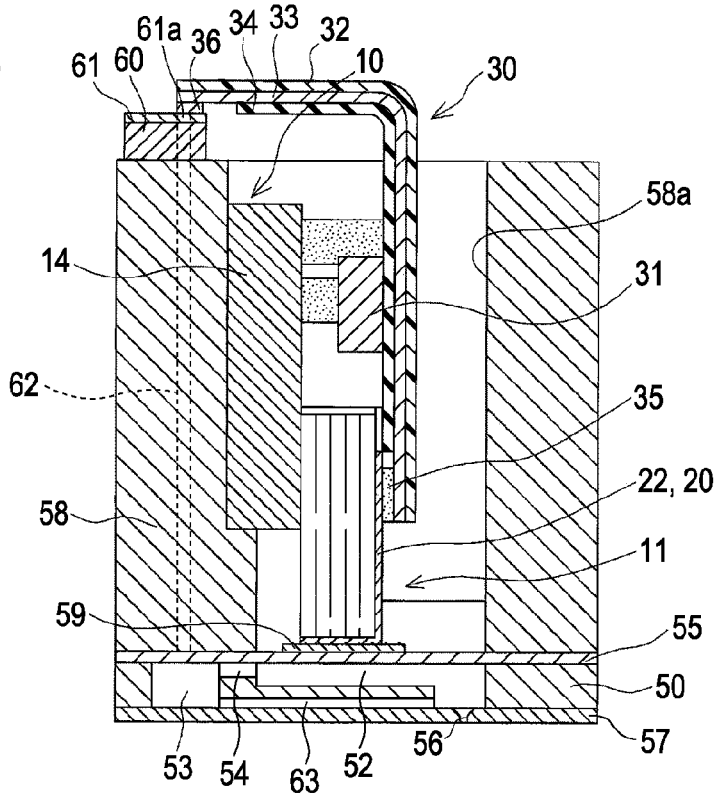

FIG. 1A is a cross-sectional view taken along a lateral direction of a pressure generating chamber of an ink jet type recording head which is an example of a liquid ejecting head according to the first embodiment of the invention, and FIG. 1B is a cross-sectional view taken along a longitudinal direction of the pressure generating chamber of the ink jet type recording head which is an example of the liquid ejecting head. As shown in FIGS. 1A and 1B, a flow channel forming substrate 50 is formed by a silicon monocrystalline substrate. In a surface layer portion of one surface side of the flow channel forming substrate 50, pressure generating chambers 52 formed by a plurality of partition walls 51 are disposed in parallel in a width direction (lateral direction) of the pressure generating chamber 52. In one end side of the longitudinal direction of each pressure generating chamber 52, a reservoir 53 for supplying ink which is one kind of liquid to each pressure generating chamber 52 is communicated with the pressure generating chamber 52 through an ink supply channel 54 which is one kind of a liquid supply channel. The ink is supplied from an ink cartridge (not shown) to the reservoir 53 through an ink supply channel 62 formed in a head case 58.

An opening surface side of the pressure generating chamber 52 of the flow channel forming substrate 50 is sealed by a vibrating plate 55, and a nozzle plate 57 from which the nozzle opening 56 is protruded is adhered to the other surface side of the pressure generating chamber 52 through an adhesive agent or a heating welding film.

Here, in the flow channel forming substrate 50 of the first embodiment, a flow channel for circulation 63 is formed. The flow channel for circulation 63 is formed in parallel to the pressure generating chamber 52 in the side of the nozzle plate 57 rather than the pressure generating chamber 52. That is, the flow channel for circulation 63 is a flow channel that is formed in parallel to the nozzle opening 56 formed in the nozzle opening side rather than the pressure generating chamber 52, and the flow channel for circulation 63 is constituted so as to separate a part of ink, which is discharged from the pressure generating chamber 52 and ejected to the outside through the nozzle opening 56, and return the part of ink to the reservoir 53. Therefore, the first embodiment is constituted so that ink is circulated in a pathway including the reservoir 53, the ink supply channel 54, the pressure generating chamber 52, and the flow channel for circulation 63. The above-described circulation configuration will be further described below.

The head case 58 including the ink supply channel connected to a plurality of ink cartridges (not shown) is fixed to the vibrating plate 55, and a piezoelectric element unit 10 is positioned with a high degree of accuracy and fixed to the head case 58. That is, a penetrating receiving portion 58*a* is provided in the head case 58, and, in one inner surface of the receiving portion 58*a*, the piezoelectric element unit 10 abuts against and is fixed to each island portion 59 in which a tip end of each piezoelectric element 11 is provided in a region corresponding to each pressure generating chamber 52 on the vibrating plate 55.

Figure 2:
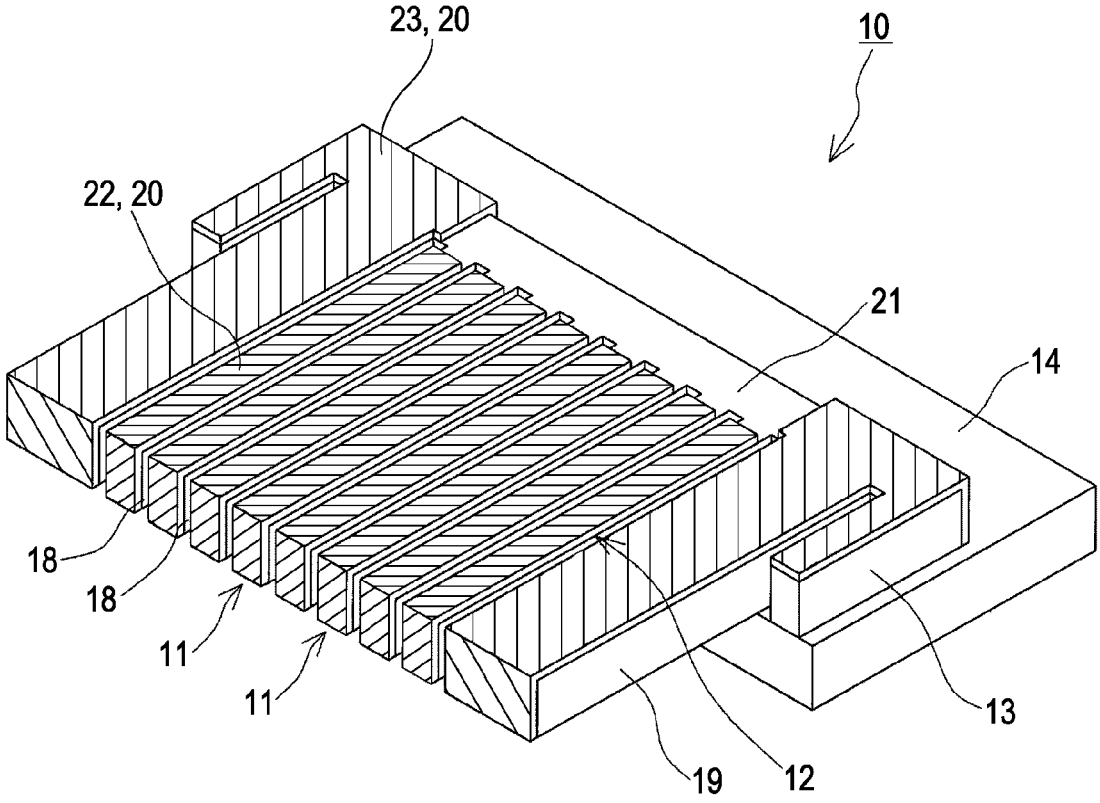
FIG. 2 is a perspective view showing a piezoelectric element unit of FIGS. 1A and 1B.

Here, the piezoelectric element unit 10 will be described in more detail with reference to further FIG. 2 and FIGS. 3A and 3B. FIG. 2 is a perspective view extracting and showing the piezoelectric element unit, and FIGS. 3A and 3B each are a plan view of FIG. 2 and a cross-sectional view taken along line IIIB-IIIB of FIG. 3A.

Figure 3A:
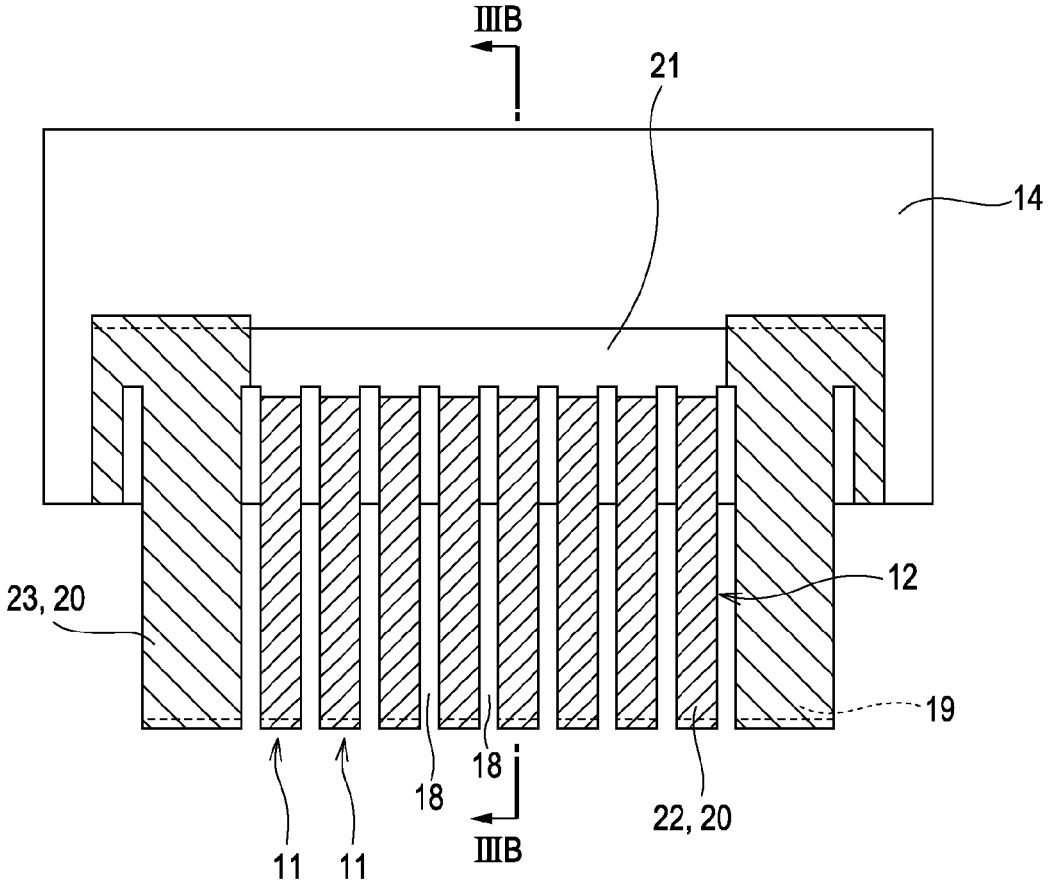
FIGS. 3A and 3B each are a plan view and a cross-sectional view showing a piezoelectric element unit of FIGS. 1A and 1B.
Figure 3B:
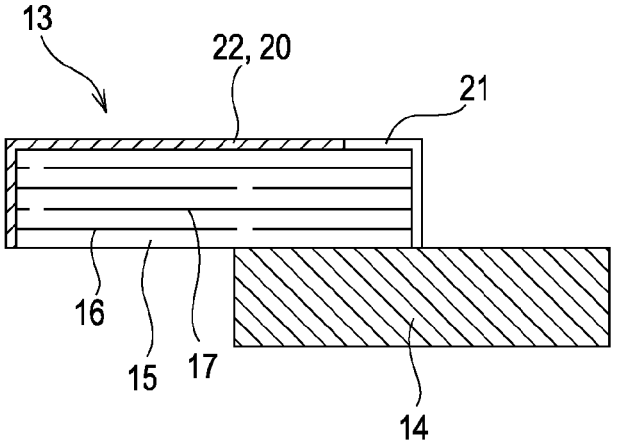

As shown in FIG. 2 and FIGS. 3A and 3B, the piezoelectric element unit 10 includes: a piezoelectric element forming member 13 that includes rows 12 in which a plurality of piezoelectric elements 11 is disposed in parallel in a width direction of the piezoelectric element; and a fixing substrate 14 to which a base end portion (one end portion) side of the piezoelectric element forming member 13 is jointed so that a tip end portion (the other end portion) side of the member 13 becomes a free end. Here, the piezoelectric element forming member 13 is constituted by alternatively disposing and laminating a piezoelectric material layer 15, individual inner electrodes 16 and common inner electrodes 17. The individual inner electrodes 16 constitute two poles of the piezoelectric element 11, that is, constitute individual electrodes which are electrically independent to adjacent piezoelectric elements 11. In addition, the common inner electrodes 17 constitute common electrodes which electrically common the adjacent piezoelectric elements 11.

Moreover, in the piezoelectric element forming member 13, a plurality of slits 18 is formed by, for example, a wire saw or the like. A tip end portion side of the silt is separated with a comb-shape and the rows 12 of the piezoelectric element 11 are formed. In addition, in both outsides of the rows 12 of the piezoelectric element 11, a positioning portion 19 which has greater width than that of each piezoelectric element 11 is provided. When the piezoelectric element unit 10 is fitted to the ink jet type recording head, the positioning portion 19 positions the piezoelectric element unit 10 with a high degree of accuracy.

Here, the individual inner electrodes 16 serving as the individual electrodes of each piezoelectric element 11 are provided substantially over an approximate entire surface of the piezoelectric element forming member 13. However, in a region facing the vicinity of an end surface of the fixing substrate 14, the individual inner electrodes are separated to a tip end portion side and a base end portion side. On the other hand, the common inner electrodes 17 serving as the common electrodes also are provided substantially over an approximate entire surface of the piezoelectric element forming member 13. However, similar to the individual inner electrodes 16, the common inner electrodes 17 are separated in the vicinity of the tip end portion of the piezoelectric element 11. That is, a region that is jointed to the fixing substrate 14 of the piezoelectric element 11 becomes an inactive region which does not contribute to the vibration. Therefore, when voltage is applied between the individual inner electrodes 16 and the common inner electrodes 17 which constitute the piezoelectric element 11, only a region of the tip end portion side which is not jointed to the fixing substrate 14 is vibrated.

In addition, in an outer surface of the piezoelectric element forming member 13, an outer electrode 20 that is connected to the individual inner electrodes 16 and the common inner electrodes 17 is formed. Moreover, in a base end portion side of a region corresponding to the row 12 of at least the piezoelectric element 11 of the piezoelectric element forming member 13, there is an electrode non-forming portion 21 in which the outer electrode 20 does not exist.

In addition, a plurality of slits 18 is formed by a length that reaches a region facing the electrode non-forming portion 21, and the outer electrode 20 is separated by the slit 18 and the electrode non-forming portion 21. Further, the outer electrode 20 includes individual outer electrodes 22 which are electrically independent to the adjacent piezoelectric element 11, and common outer electrodes 23 which are electrically common to the adjacent piezoelectric element. Specifically, the outer electrode 20 is separated into a region that faces each piezoelectric element 11 and a region that faces the positioning portion 19, and the outer electrode 20 of the region facing each piezoelectric element 11 is included in an individual outer electrodes 22 that are electrically connected to the individual inner electrodes 16 constituting the individual electrodes of the piezoelectric element 11 at the tip end portion of the piezoelectric element forming portion 13.

On the other hand, the outer electrode 20 of the positioning portion 19 installed in both sides of the rows 12 of the piezoelectric element 11 is included in the common outer electrodes 23 connected to the common inner electrodes 17 constituting the common electrodes of each piezoelectric element 11 at the end surface of the base end portion side of the piezoelectric element forming member 13. That is, in the piezoelectric element unit 10, the individual outer electrodes 22 are disposed in parallel to a surface of the opposite side of the portion which is jointed to the fixing substrate 14 of the piezoelectric element forming member 13, and the common outer electrodes 23 exist in a region facing the positioning portion 19 at both sides of the parallel direction of the individual outer electrodes 22. Therefore, the piezoelectric element units 10 can be connected to a wiring substrate described below with relative ease, and miniaturization of the piezoelectric element unit 10 can be improved.

As shown in FIGS. 1A and 1B, in the above-described piezoelectric element unit 10, a surface of the fixing substrate 14 opposite to a surface to which the piezoelectric element 11 is fixed is fixed to a receiving portion 58*a* of the head case 58. In addition, a film-shaped wiring substrate 30 that supplies a signal for driving each piezoelectric element 11 is connected to the piezoelectric element unit 10.

The wiring substrate 30 includes a connection wiring 33 that is connected to the individual outer electrodes 22 and the common outer electrodes 23 of the piezoelectric element 11. A driving IC 31 that supplies a driving signal for driving each piezoelectric element 11 is mounted on the wiring substrate 30. As the wiring substrate 30, for example, a tape carrier package (TCP) or the like such as TAB tape can be appropriately applied. The wiring substrate 30 may be constituted as follows. That is, a conductive layer of a predetermined pattern is formed on a surface of a base film 32 such as polyimide by a copper foil or the like, and after the connection wiring 33 is formed by coating the conductive layer, an insulating film 34 such as a resist is coated on regions other than a region in which the piezoelectric element 11 of the connection wiring 33 and a terminal portion described below are connected to each other and a region to which a terminal of the driving IC 31 is connected. Here, after the driving IC 31 is mounted on the wiring substrate 30, the driving IC 31 is coated by the insulating film 34 that coats the connection wiring 33.

The above-described wiring substrate 30 is disposed such that the driving IC 31 becomes a surface side that faces the fixing substrate 14 and the driving IC 31 becomes a central region of the width direction of the wiring substrate 30. In addition, one end portion of the connection wiring 33, the individual outer electrodes 22 of the end portion side to which the fixing substrate 14 of the piezoelectric element 11 is fixed, and the common outer electrodes 23 are electrically connected to one another through a metal layer 35. In this regard, for example, after a metal such as tin (Sn)-bismuth (Bi) alloy is formed on the surface of the connection wiring 33 and the surfaces of the individual outer electrodes 22 and the common outer electrodes 23, the metal layer 35 is formed by heating both surfaces in a state where both surfaces are abutted to each other.

In addition, the other end opposite to one end connected to the piezoelectric element 11 of the connection wiring 33 of the wiring substrate 30 are bent and connected to a terminal portion 61*a* of an input wiring 61 of an input wiring substrate 60 installed to the surface which is the side opposite to the vibrating plate 55 of the head case 58.

Here, the input wiring substrate 60 installed to the head case 58 supplies a driving voltage and a printing signal or the like to the driving IC 31 and the piezoelectric element 11 from the outside. In addition, since the above-described input wiring substrate 60 is provided on the surface of the side that is opposite to the vibrating plate 55 of the head case 58, in the wiring substrate 30 that is connected to the piezoelectric element 11 fixed to the receiving portion 58*a*, a portion that is connected to a terminal portion 61*a* of the input wiring 61 of the input wiring substrate 60 is approximately bent at 90°, and the end portion of the connection wiring 33 is connected to the terminal portion 61*a*. Moreover, for example, after a metal such as tin-phosphor copper alloy is formed on the surface of the terminal portion 61*a* of the input wiring 61, the connection wiring 33 and the terminal portion 61*a* are electrically connected to each other through a metal layer 36 formed by heating the connection wiring and the terminal portion in a state where both are abutted. Further, the wiring substrate 30 is adhered to the fixing substrate 14 by an ultraviolet curing adhesive agent (UV adhesive agent) 40, 41, and 42.

In the above-described ink jet type recording head, ink is supplied to the reservoir 53 through the ink supply channel 62 which is communicated with the ink cartridge, and the ink is distributed to each pressure generating chamber 52 through the ink supply channel 54. At this time, when the piezoelectric element 11 is contracted by applying voltage to the piezoelectric element 11, the vibrating plate 55 is lifted along with the piezoelectric element 11, and the volume of the pressure generating chamber 52 is increased. As a result, the ink is sucked in the pressure generating chamber 52. Further, after the ink fills the inside of the pressure generating chamber 52 until the ink reaches the nozzle opening 56, when the voltage applied to the piezoelectric element 11 is released according to the recording signal from the driving IC 31, the piezoelectric element 11 is extended and returns to the original state. Therefore, since the vibrating plate 55 is also displaced and returns to the original state, the pressure generating chamber 52 is contracted, and the inner pressure discharges the ink filled in the pressure generating chamber 52. As a result, at the same time when the ink is ejected from the nozzle opening 56, a part of the ink is returned to the reservoir 53 through the flow channel for circulation 63. At this time, ejecting characteristics of ink are defined by the ink supply channel 54, and inertance and a flow channel resistance of the nozzle opening 56 and the flow channel for circulation 63.

Figure 4:
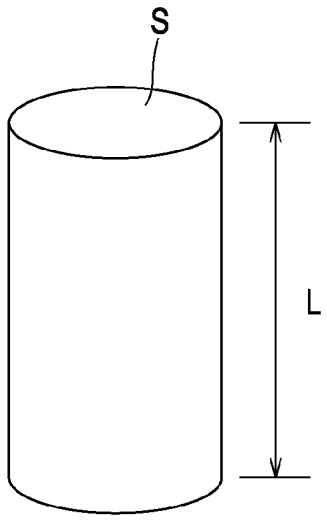
FIG. 4 is an explanatory view showing an inertance of a flow channel.

In addition, when the flow channel can be approximated to a hollow cylindrical body as shown in FIG. 4, the inertance M can be obtained as follows.

$$M=\rho(L/S)$$

(here, L: a length of the flow direction, S: a vertical area, and ρ: a liquid density).

In the first embodiment, when the inertances of the ink supply channel 54, the nozzle opening 56, and the flow channel for circulation 63 each are termed Ms, Mn, and Mc, the first embodiment is constituted so that the following expressions 1 and 2 are established.

$$Ms \geq (1/Mn+1/Mc)^{-1} \quad (1)$$

$$Mc>Mn \quad (2)$$

Simultaneously, when the flow channel resistances of the nozzle opening 56 and the flow channel for circulation 63 each are given as Rn and Rc, the first embodiment is constituted so that the following expression 3 is established.

$$Mn/Rn<Mc/Rc \quad (3)$$

Figure 5:
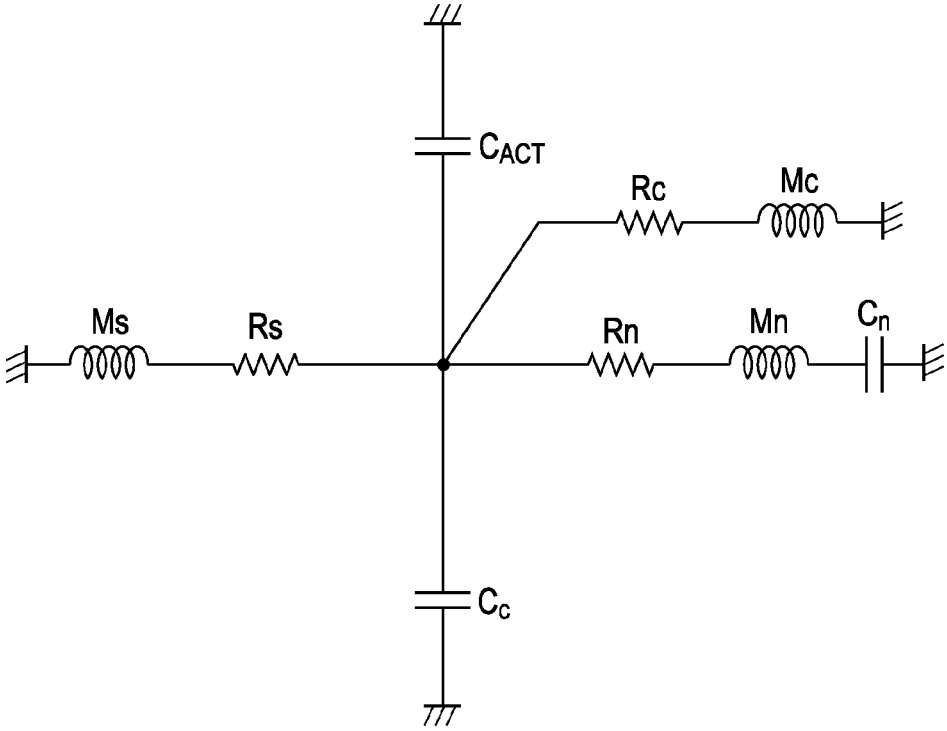
FIG. 5 is a circuit view showing an equivalence circuit of a flow channel.

In this case, an equivalent circuit can be shown as FIG. 5. As shown in FIG. 5, the nozzle opening 56 and the flow channel for circulation 63 are constituted so as to be connected in parallel with respect to the ink supply channel 54. In addition, in FIG. 5, $C_{ACT}$ indicates a compliance of the piezoelectric element 11, $C_c$ indicates a compliance of the pressure generating chamber 52, and $C_n$ indicates a compliance of the meniscus in the nozzle opening 56.

As can be clearly seen with reference to FIG. 5, the expression 1 illustrates that parallel composite inertances of the nozzle opening 56 and the flow channel for circulation 63 are smaller than or equal to the inertance Ms of the ink supply channel 54. Therefore, by satisfying the condition of the expression 1, the ink discharged from the pressure generating chamber 52 is more effectively supplied to the nozzle opening 56 side and the flow channel for circulation 63 side.

Moreover, the expression 2 illustrates that the inertance Mn of the nozzle opening 56 is smaller than the inertance Mc of the flow channel for circulation 63. Therefore, by satisfying the condition of the expression 2, the ink discharged from the pressure generating chamber 52 can be more effectively ejected through the nozzle opening 56, and the ejecting efficiency can be the same as that of the ink jet type recording head of the related art which does not have the flow channel for circulation 63.

The expression 3 illustrates that the ratio between the inertance Mn and the flow channel resistance Rn in the nozzle opening 56 is smaller than the ratio between the inertance Mc and the flow channel resistance Rc in the flow channel for circulation 63. The expression 3 is an index that represents a damping degree of vibration of the ink in each flow channel including the nozzle opening 56 and the flow channel for circulation 63, and the expression 3 represents that the vibration in the nozzle opening 56 is rapidly dampened compared to the vibration in the flow channel for circulation 63. Therefore, a self circulation is satisfactory performed, and the effect on the printing characteristics can be minimized. Here, the self circulation means a method in which the ink discharged from the pressure generating chamber 52 is circulated through the flow channel for circulation 63, the reservoir 53, the ink supply channel 54, and the pressure generating chamber 52 by using a driving force of the piezoelectric element 11 without using an outside driving source. When the above-described self circulation is performed (the case of the first embodiment), the expression 3 becomes an especially suitable condition. The reason is because it is preferable to rapidly dampen the vibration of the ink in the nozzle opening 56.

Since the ink jet type recording head according to the first embodiment is constituted so that the recording head satisfies the conditions of the expressions 1 and 2, most of the ink discharged from the pressure generating chamber 52 when the printing is performed or the like is ejected through the nozzle opening 56. Therefore, the ejecting characteristics of the above-described case can be the same as that of the ink jet type recording head of the related art which does not have the flow channel for circulation 63. On the other hand, since the ink discharged from the pressure generating chamber 52 is circulated in a pathway including the reservoir 53, the ink supply channel 54, and the pressure generating chamber 52 through the flow channel for circulation 63, fresh ink can always be supplied to the vicinity of the nozzle opening 56, and thickening of the ink can be preferably suppressed. As a result, it is possible to prevent the ejecting characteristics of ink from deteriorating due to the thickening of the ink while not discarding uneconomically the ink.

Here, the piezoelectric element 11 may be driven at a high frequency (for example, 30 kHz) when typical operation such as the printing is performed, and the piezoelectric element 11 may be driven at a low frequency (for example, 2 kHz) when the self circulation is performed.

Second Embodiment

Figure 6A:
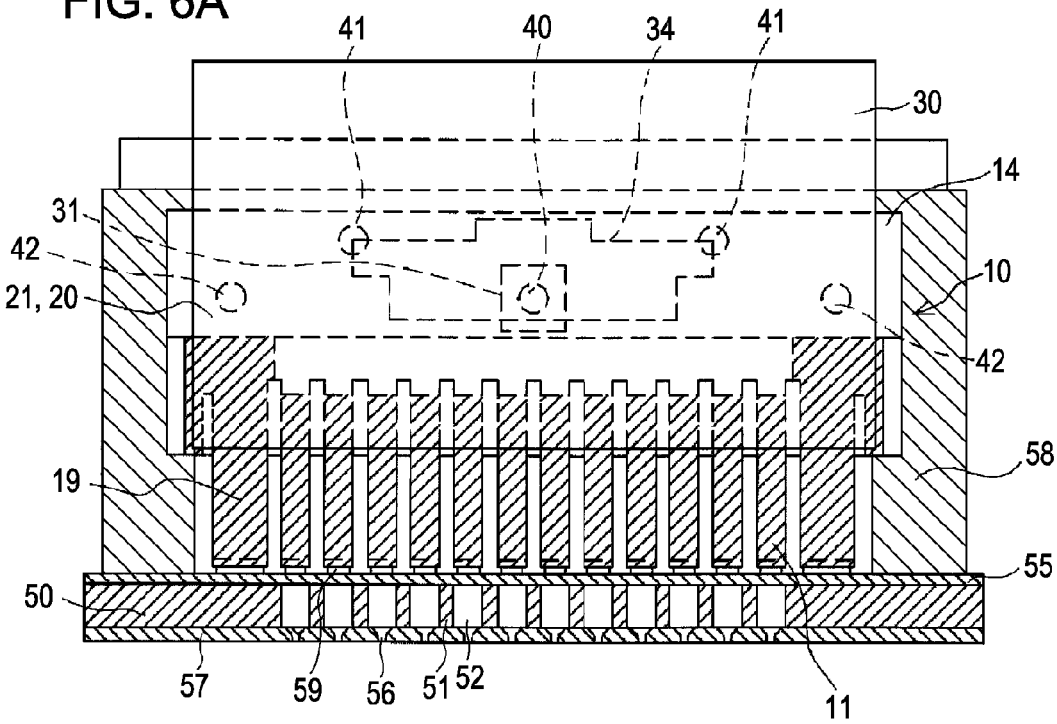
FIGS. 6A and 6B are cross sectional-views showing a recording head according to a second embodiment.
Figure 6B:
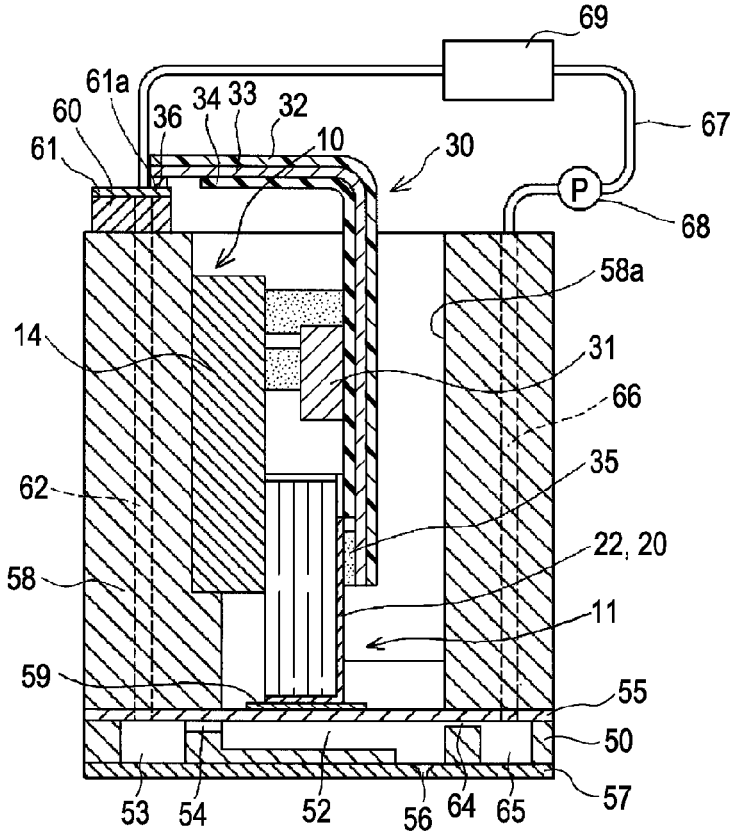

FIGS. 6A and 6B are views showing an ink jet type recording head which is an example of a liquid ejecting head according to a second embodiment of the invention, FIG. 6A is a cross-sectional view of the lateral direction of the pressure generating chamber, and FIG. 6B is a cross-sectional view of the longitudinal direction of a pressure generating chamber of the ink jet type recording head which is an example of the liquid ejecting head. In addition, in FIGS. 6A and 6B, same parts as those of FIGS. 1A and 1B are denoted by same reference numbers, and the description thereof will not be repeated.

As shown in FIGS. 6A and 6B, the second embodiment is a forcible circulation method that circulates ink by using a pump 68, which is an outside driving source. The circulation of the second embodiment is performed in the following pathway. That is, the pathway is formed from the ink cartridge 69 storing ink to the reservoir 53 through the ink supply channel 62, and is formed to return the ink cartridge 69 via the ink supply channel 54, the pressure generating chamber 52, the flow channel for circulation 64, the reservoir 65, the ink supply channel 66, and the pump 68. Here, similar to the first embodiment, the flow channel for circulation 64 is formed in parallel to the nozzle opening 56 in the nozzle opening side rather than the pressure generating chamber 52, and the flow channel for circulation 64 is constituted so as to separate a part of the ink discharged from the pressure generating chamber 52. However, in the second embodiment, the ink does not return to the reservoir 53 (in the first embodiment, the ink returns the reservoir 53), and the flow channel for circulation 64 is formed so as to directly communicate with a separated reservoir 65. The reservoir 65 is formed in the end portion of the side which is opposite to the reservoir 53 of the flow channel forming substrate 50, and the reservoir 65 is communicated with an ink supply channel 66 formed in the end portion of the side which is opposite to the ink supply channel 62 of the head case 58. The pump 68 is connected to an upper end opening of the ink supply channel 66 through a flow channel 67.

Also in the second embodiment, when inertances of the ink supply channel 54, the nozzle opening 56, and the flow channel for circulation 64 each are given as Ms, Mn, and Mc, and flow resistances of the nozzle opening 56 and the flow channel for circulation 64 each are given as Rn and Rc, the second embodiment is constituted so that the above-described expressions 1, 2, and 3 are established.

Therefore, the second embodiment is different to the first embodiment only in that the second embodiment adopts the forcible circulation method while the first embodiment adopts the self circulation method, and the second embodiment is similar to the first embodiment in that the two embodiments adopt the circulation method. Thus, the operation and effects of the second embodiment can be exerted similarly to those of the first embodiment.

In addition, since the ink jet type recording head according to the second embodiment adopts the forcible circulation method, the condition of the above-described expression 3 is not necessarily satisfied. The reason is because expression 3 can apply especially useful conditions when the self circulation method is adopted.

Other Embodiments with Respect to Liquid Ejecting Head

Hereinbefore, the embodiments according to the invention are described. However, it is needless to say that the invention is not limited thereto. For example, the ink jet type recording head according to the above-described embodiments is the head that includes a vertical vibrating type actuator in which the piezoelectric material and the electrode forming material are laminated to each other and extended and contracted in the axial direction. However, the ink jet type recording head can be similarly applied to a head that includes a piezoelectric element being a thin film type actuator as the pressure generating unit for generating the variation in pressure in the pressure generating chamber, or to a head that includes a piezoelectric element being a thick film type actuator formed by, for example, a method of adhering a green sheet, and the like. In addition, the ink jet type recording head according to the above-described embodiments can be also applied to a so-called bubble type actuator in which a heater element is disposed in the pressure generating chamber as the pressure generating unit and the ink droplet is ejected from the nozzle opening by a bubble which is generated by heating of the heater element, or a so-called electrostatic type actuator in which static electrical charge is generated between the vibrating plate and the electrode, the vibrating plate is deformed by electrostatic force, and the ink droplet is ejected from the nozzle opening. In conclusion, if the ink jet type recording head adopts the configuration which includes the flow channel for circulation which is formed in parallel to the nozzle opening in the nozzle opening side rather than the pressure generating chamber and separates a part of ink discharged from the pressure generating chamber, and circulates the ink which flows to and is communicated with the pressure generating chamber, the ink jet type recording head can be applied without limitation. In addition, when the ink jet type recording head is applied, the recording head can obtain the same operation and effects as those of the above-described embodiments.

Moreover, since the invention is intended for all liquid ejecting heads, it is needless to say that the invention can be also applied to liquid ejecting heads that eject liquid other than ink. As other liquid ejecting heads, for example, there are as follows: various recording heads that are used in an image recording apparatus such as a printer; a color material ejecting head that is used for manufacturing a color filter included in such as a liquid crystal display; an electrode material ejecting head that is used for forming an electrode such as an organic EL display, an FED (a field emission display); and a bioorganic material ejecting head that is used for manufacturing an ion chip.

Figure 7:
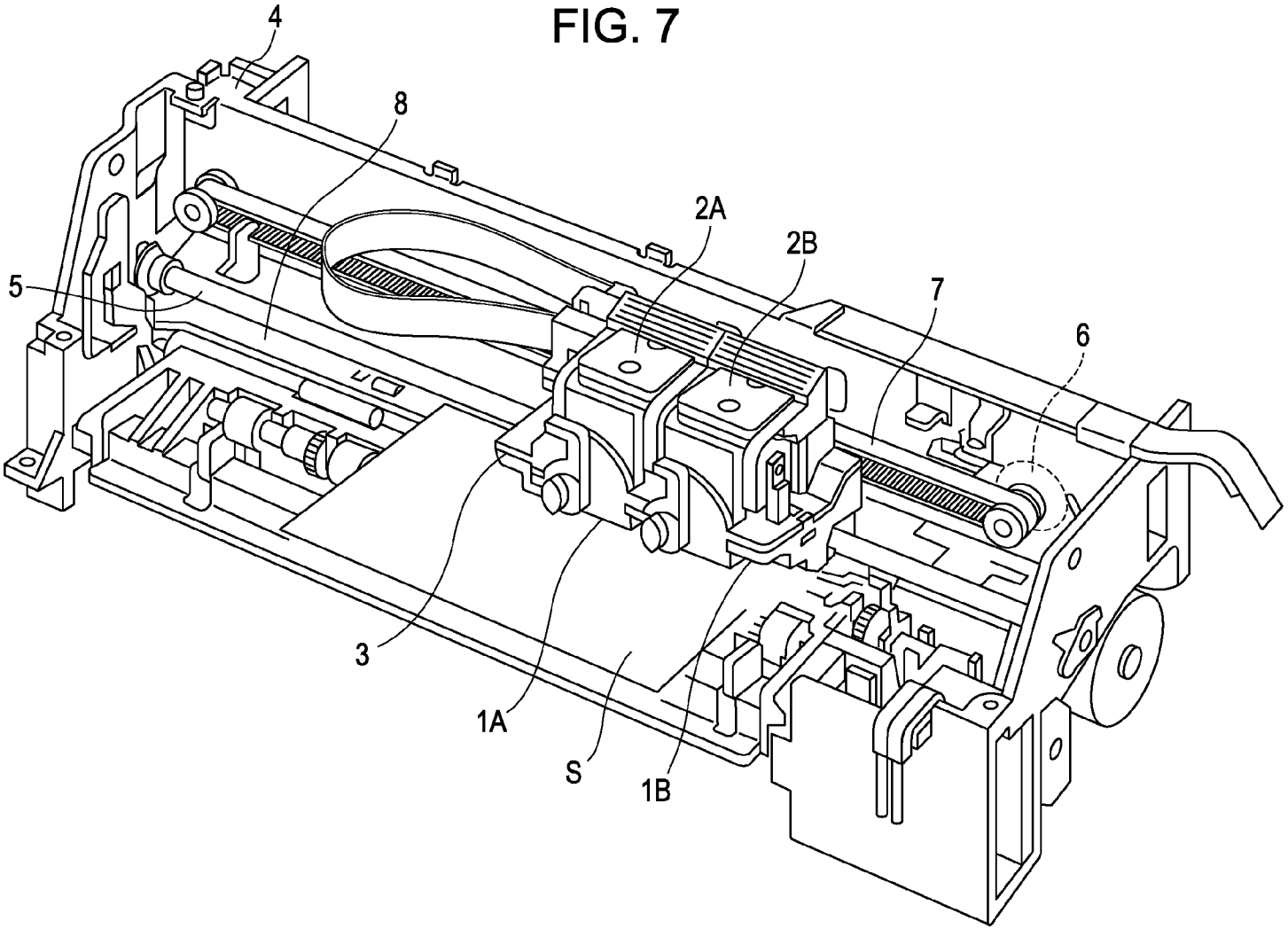
FIG. 7 a schematic view showing a recording apparatus according to an embodiment.

Liquid Jet Type Recording Apparatus Including Liquid Ejecting Head According to the Embodiments of the Invention The ink jet type recording head according to the above-described embodiments constitutes a part of the recording head unit that includes the ink flow channel communicating with the ink cartridge or the like, and is mounted on an ink jet type recording apparatus. FIG. 7 is a schematic view showing an example of the ink jet type recording apparatus. As shown in FIG. 7, in the recording head units 1A and 1B including the ink jet type recording head according to the above-described embodiments, cartridges 2A and 2B included in an ink supply unit are detachably provided, and a carriage 3 on which the recording head units 1A and 1B are mounted is movably installed in the shaft direction of a carriage shaft 5 attached to an apparatus main body 4. For example, the recording head units 1A and 1B each eject a black ink composition and a color ink composition.

In addition, since the driving force of a driving motor 6 is transferred to the carriage 3 via a plurality of gears (not shown) and a timing belt 7, the carriage 3 on which the recording head units 1A and 1B are mounted moves along the carriage shaft 5. On the other hand, a platen 8 is provided in the apparatus main body 4 along the carriage shaft 5, and a recording sheet S that is the recording medium such as paper fed by a feeding roller (not shown) or the like is wound on the platen 8 and transported.

What is claimed is:

1. A liquid ejecting head comprising:

a vibrating plate;

a nozzle plate;

a pressure generating chamber, wherein liquid is supplied to the pressure generating chamber through a liquid supply channel;

a pressure generating unit that generates a variation in pressure in the pressure generating chamber;

a nozzle opening that ejects the liquid discharged from the pressure generating chamber according to the variation in the pressure, wherein the nozzle opening is formed in the nozzle plate ; and a flow channel for circulation, wherein the flow channel for circulation separates a part of the liquid discharged from the pressure generating chamber towards the nozzle opening and circulates the part of the liquid back to a liquid reservoir through the flow channel for circulation, wherein the flow channel for circulation and the pressure generating chamber are formed between the vibrating plate and the nozzle plate and wherein the flow channel for circulation is formed on a side of the nozzle plate and the pressure generating chamber is formed on a side of the vibrating plate, wherein Ms, Mn, and Mc are inertances of, respectively, the liquid supply channel, the nozzle opening, and the flow channel for circulation, and a relationship of $Ms \geq (1/Mn+1/Mc)^{-1}$ is established.

2. The liquid ejecting head according to claim 1, wherein the flow channel for circulation is formed in parallel to the nozzle opening.

3. The liquid ejecting head according to claim 1, wherein a relationship of $Mc>Mn$ is established.

4. The liquid ejecting head according to claim 1, wherein when Rn and Rc each are pathway resistances of the nozzle opening and the flow channel for circulation, a relationship of $Mn/Rn<Mc/Rc$ is established.

5. A liquid ejecting apparatus comprising the liquid ejecting head according to claim 1.

6. A liquid ejecting apparatus comprising the liquid ejecting head according to claim 2.

7. A liquid ejecting apparatus comprising the liquid ejecting head according to claim 3.

8. A liquid ejecting apparatus comprising the liquid ejecting head according to claim 4.

* * * * *